US007066462B2

(12) United States Patent
Rilitz et al.

(10) Patent No.: US 7,066,462 B2
(45) Date of Patent: Jun. 27, 2006

(54) METHOD OF AND APPARATUS FOR STACKING SHEETS OF PAPER AND THE LIKE

(75) Inventors: Norbert Rilitz, Norderstedt (DE); Eckhardt Borutta, Zeven (DE); Fritz Schulz, Hamburg (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 10/164,316

(22) Filed: Jun. 7, 2002

(65) Prior Publication Data

US 2002/0185808 A1 Dec. 12, 2002

(30) Foreign Application Priority Data

Jun. 7, 2001 (DE) ..... 101 27 452

(51) Int. Cl.
*B65H 31/10* (2006.01)

(52) U.S. Cl. ..... 271/217; 271/214; 271/215; 271/155; 271/200; 271/201; 271/207

(58) Field of Classification Search ..... 271/214, 271/215, 217, 155, 200, 201; 414/794.5
See application file for complete search history.

(56) References Cited

U.S. PATENT DOCUMENTS

| | | | | |
|---|---|---|---|---|
| 815,008 | A | * 3/1906 | Davidson | 271/201 |
| 2,642,221 | A | * 6/1953 | Offutt et al. | 254/35 |
| 2,660,432 | A | * 11/1953 | Wilske et al. | 271/201 |
| 3,419,266 | A | * 12/1968 | Merrill | 21/189 |
| 3,549,144 | A | * 12/1970 | Lucas | 271/201 |
| 3,628,787 | A | * 12/1971 | Boeve | 271/201 |
| 3,908,985 | A | * 9/1975 | Wiseman | 271/189 |
| 4,062,537 | A | * 12/1977 | Dietrich | 271/201 |
| 4,265,443 | A | * 5/1981 | Berthelot | 271/182 |

(Continued)

FOREIGN PATENT DOCUMENTS

| | | |
|---|---|---|
| CH | 408 064 | 9/1966 |
| DE | 42 24 010 A1 | 2/1993 |
| DE | 43 05 579 A1 | 8/1994 |
| DE | 93 04 964.1 U1 | 9/1994 |
| DE | 196 01 549 A1 | 9/1996 |
| DE | 199 28 367 A1 | 12/2000 |
| EP | 0 745 546 A2 | 4/1996 |
| EP | 0 899 229 A2 | 3/1999 |

OTHER PUBLICATIONS

Koshida Yoshinori, "Paper Sheet Stacking Mechanism", Patent Abstracts of Japan, JP 6255860, Sep. 13, 1994.

*Primary Examiner*—Donald P. Walsh
*Assistant Examiner*—Matthew J. Kohner
(74) *Attorney, Agent, or Firm*—Venable LLP; Robert Kinberg; Catherine M. Voorhees

(57) ABSTRACT

A stream of successive sheets of paper, foil or the like is converted into a series of piles at a stacking station where successive sheets are caused to descend onto a pallet which is adjacent a monitoring device serving to transmit signals denoting the levels of successive uppermost sheets of a growing pile. Such signals are processed by a unit which controls one or more valves in a pneumatic elevator for the discharge end of the endless flexible conveyor which supplies successive sheets to the stacking station. The elevator ensures that the distance between the discharge end of the conveyor and the uppermost sheets of the growing pile remains within a preselected range. This contributes to the accuracy of stacking of sheets on their pallet.

21 Claims, 2 Drawing Sheets

U.S. PATENT DOCUMENTS 4,279,555 A * 7/1981 Rydell ..... 414/793.8
4,359,218 A * 11/1982 Karis ..... 271/188
4,552,351 A * 11/1985 Tsukamoto ..... 271/315
4,564,189 A * 1/1986 Noll, Jr. ..... 271/201
4,577,853 A * 3/1986 Duke ..... 271/217
4,802,664 A * 2/1989 Larsen ..... 271/201
4,880,350 A * 11/1989 Stobb ..... 414/790.2
4,958,827 A * 9/1990 Kaneko ..... 271/176
5,104,105 A * 4/1992 Cote et al. ..... 270/1.02
5,397,120 A 3/1995 Schulz et al.
5,439,209 A * 8/1995 Runzi ..... 271/251
5,524,877 A * 6/1996 Weber et al. ..... 271/220
5,672,045 A * 9/1997 Schmid et al. ..... 414/794.5
5,732,942 A * 3/1998 Crameri et al. ..... 271/176
6,003,861 A * 12/1999 Iizumi et al. ..... 271/215
6,145,826 A * 11/2000 Kawata ..... 270/58.28
6,234,473 B1 * 5/2001 Morgan et al. ..... 271/201
6,296,247 B1 * 10/2001 Tamura et al. ..... 271/214
6,427,999 B1 * 8/2002 Christofferson ..... 271/201

* cited by examiner

METHOD OF AND APPARATUS FOR STACKING SHEETS OF PAPER AND THE LIKE

CROSS-REFERENCE TO RELATED CASES

The present application claims the priority of the commonly owned copending German patent application Serial No. 101 27 452.1 filed Jun. 7, 2001. The disclosure of the aforementioned priority application, as well as that of each US and foreign patent and patent application identified in the specification of the present patent application, is incorporated herein by reference.

BACKGROUND OF THE INVENTION

This invention relates to improvements in methods of and in apparatus for stacking sheets of paper and the like, and more particularly to improvements in methods of and in apparatus for converting one or more elongated streams or flows of partially overlapping or non-overlapping sheets or panels into one or more series of stacks of fully overlapping sheets or panels. Such methods and apparatus include the step of or the means for moving and guiding successive foremost sheets or panels (hereinafter called sheets) of each stream or flow (hereinafter referred to as stream) downwardly upon arrival at a stacking or gathering station (hereinafter called stacking station) or at the respective stacking station so that the descending sheet(s) comes or come to rest upon the immediately preceding (already stacked) sheet(s) to thus become part of a single stack or of the respective stack of two or more simultaneously gathered stacks.

Methods or apparatus of the just outlined character are carried out or constructed and assembled in such a way that each freshly delivered sheet is spaced apart from the immediately preceding (i.e., already stacked) sheet in order to avoid interference between such sheets at the stacking station. As used herein, the expression "sheet" is intended to encompass or denote sheets or panels or plates which are made of paper as well as sheets, plates, panels or foils made of metallic or plastic materials, mats and/or others. Such sheets can be obtained by subdividing a running strip into a single series of partly overlapping (imbricated) or non-overlapping sheets of a desired size and/or shape, or by splitting a wide panel into two or more strips and by thereupon utilizing one or more transverse cutters to subdivide each strip into a series of partially overlapping or non-overlapping sheets.

Apparatus of the class to which the present invention pertains are disclosed, for example, in commonly owned U.S. Pat. No. 5,397,120 granted Mar. 14, 1995 to Friedrich Schulz et al. for "APPARATUS FOR STACKING SHEETS". The patented apparatus is constructed and assembled to gather paper sheets (26) or the like into piles or stacks (52) and employs a vertically movable carrier or platform (16) with associated endless belt or band conveyors (23, 24), a stop (21) for the front edges of successive oncoming sheets, and a rigid elongated rod-like deflector (31) which is adjacent the stop. A ramp (37) is provided to direct successive sheets to the stacking or gathering station and is provided with a window (38) for the lower reaches or stretches of the belt conveyors. The patented apparatus operates satisfactorily, especially at a median or at a relatively low speed and if the material of the sheets can stand reasonable deforming stresses, especially in the regions of the leaders (i.e., front end portions) of sheets approaching the stacking station.

OBJECT OF THE INVENTION

An object of the present invention is to provide a novel and improved method of and a novel and improved apparatus for stacking sheets of paper or the like which are less dependent upon the quality and/or upon the size and/or upon the composition of the sheets than heretofore known methods and apparatus.

SUMMARY OF THE INVENTION

One feature of the present invention resides in the provision of a method of converting at least one stream of successive sheets into at least one series of piles or stacks of sheets at a stacking station. The improved method comprises the steps of advancing successive sheets of the at least one stream of sheets to the stacking station along a predetermined path having a discharge end at the stacking station, accumulating the sheets at the stacking station into a growing stack having uppermost sheets constituted by successive sheets of the at least one stream and being spaced apart from the discharge end of the predetermined path, and changing the level of the discharge end of the predetermined path when necessary to ensure that the distance between the discharge end of the predetermined path and successive uppermost sheets of the growing stack remains at least substantially constant.

The method preferably further comprises the steps of monitoring the distance between the discharge end of the predetermined path and successive uppermost sheets of the growing stack at the stacking station, and comparing the monitored distance with a predetermined distance. The level changing step of such method preferably includes changing the level of the discharge end of the predetermined path when the monitored distance departs from the predetermined distance, particularly when the monitored distance departs from the predetermined distance to a predetermined extent. Such predetermined extent can encompass or embrace a predetermined range of tolerances.

The method can further comprise the steps of lowering the growing stack in the course of the accumulating step, and removing the stack from the stacking station when the number of sheets in the stack rises to a predetermined number and/or when the height of the stack reaches a predetermined value.

The accumulating step of the improved method can include depositing successive sheets of the at least one stream upon a removable first support (e.g., a pallet) at the stacking station, and such method can further comprise the steps of removing the first support from the stacking station when the number of sheets in the fully grown stack on the first support reaches a preselected number and/or when the height of the stack reaches a preselected height, replacing the removed first support with an empty second support, and raising the second support at the stacking station toward the discharge end of the predetermined path. Still further, such method can comprise the steps of lowering the first support and the fully grown stack thereon prior to the removing step, and lowering the discharge end of the predetermined path simultaneously with lowering of the first support and the fully grown stack on the first support.

Another feature of the present invention resides in the provision of an apparatus for converting at least one stream of successive sheets into at least one series of piles or stacks of sheets at a stacking station. The improved apparatus comprises means for advancing successive sheets of the at least one stream of sheets to the stacking station along a predetermined path to a discharge end of the advancing means above the stacking station, means for accumulating the sheets at the stacking station into a growing pile or stack having uppermost sheets constituted by successive sheets of the at least one stream and being spaced apart from the discharge end, and means for changing the level of the discharge end of the predetermined path whenever necessary to ensure that the distance between the discharge end of the predetermined path and successive uppermost sheets of the growing stack at the stacking station remains at least substantially constant.

The apparatus further comprises or employs at least one removable support (such as a pallet) which is located at the stacking station and serves to carry the sheets of the growing stack.

The advancing means of the improved apparatus can comprise at least one endless flexible element (such as an endless belt or band) which is arranged to advance and guide successive sheets of the at least one stream and has an end turn disposed at the discharge end of the predetermined path and located at the aforementioned distance from the uppermost sheets of the stack then growing at the stacking station.

The advancing means can also comprise (preferably in addition to the at least one endless flexible element) at least one sheet deflector which is arranged to guide successive sheets of the at least one stream and has a sheet-contacting surface disposed at the discharge end of the predetermined path and being located at the aforementioned distance from the uppermost sheets of the stack then growing at the stacking station.

The improved apparatus can further comprise means (such as an elevator) for lowering that support which is located at the stacking station and is in the process of gathering a pile of superimposed sheets.

The level changing means can include at least one fluid-operated motor, e.g., an arrangement which employs compressed air or another gas and includes at least one radially expansible and contractible hose.

The just described or other suitable level changing means can further include signal generating means (e.g., a combination of two cooperating photoelectronic detectors) for monitoring the distance between the discharge end of the predetermined path and successive uppermost sheets of the growing stack at the stacking station, means (e.g., a computer) for comparing the monitored distance with a predetermined distance, and means for moving the discharge end of the predetermined path when the monitored distance departs from the predetermined distance.

The just mentioned moving means is or can be arranged to change the level of the discharge end of the predetermined path when the extent of departure of the monitored distance from the predetermined distance is within a predetermined range. The apparatus embodying the just described or other suitable monitoring means can further comprise means for maintaining the monitoring means and the discharge end of the predetermined path in fixed positions relative to each other (e.g., they can be mounted on a common carrier in the form of a holder, bracket or arm). The discharge end of the predetermined path and the monitoring means can be spaced apart from each other by a distance which at least approximates the aforementioned predetermined distance.

The moving means can include means for moving the discharge end of the pedetermined path in synchronism with the monitoring means.

If the improved apparatus further comprises or cooperates with suitable insertable and removable devices (such as the aforementioned pallets or the like) for supporting growing stacks at the stacking station, the level changing means is or can be operative to change the level of the discharge end of the predetermined path during accumulation of sheets on a pallet occupying the stacking station, during insertion of a pallet into the stacking station, as well as during removal of a stack-carrying pallet from the stacking station.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
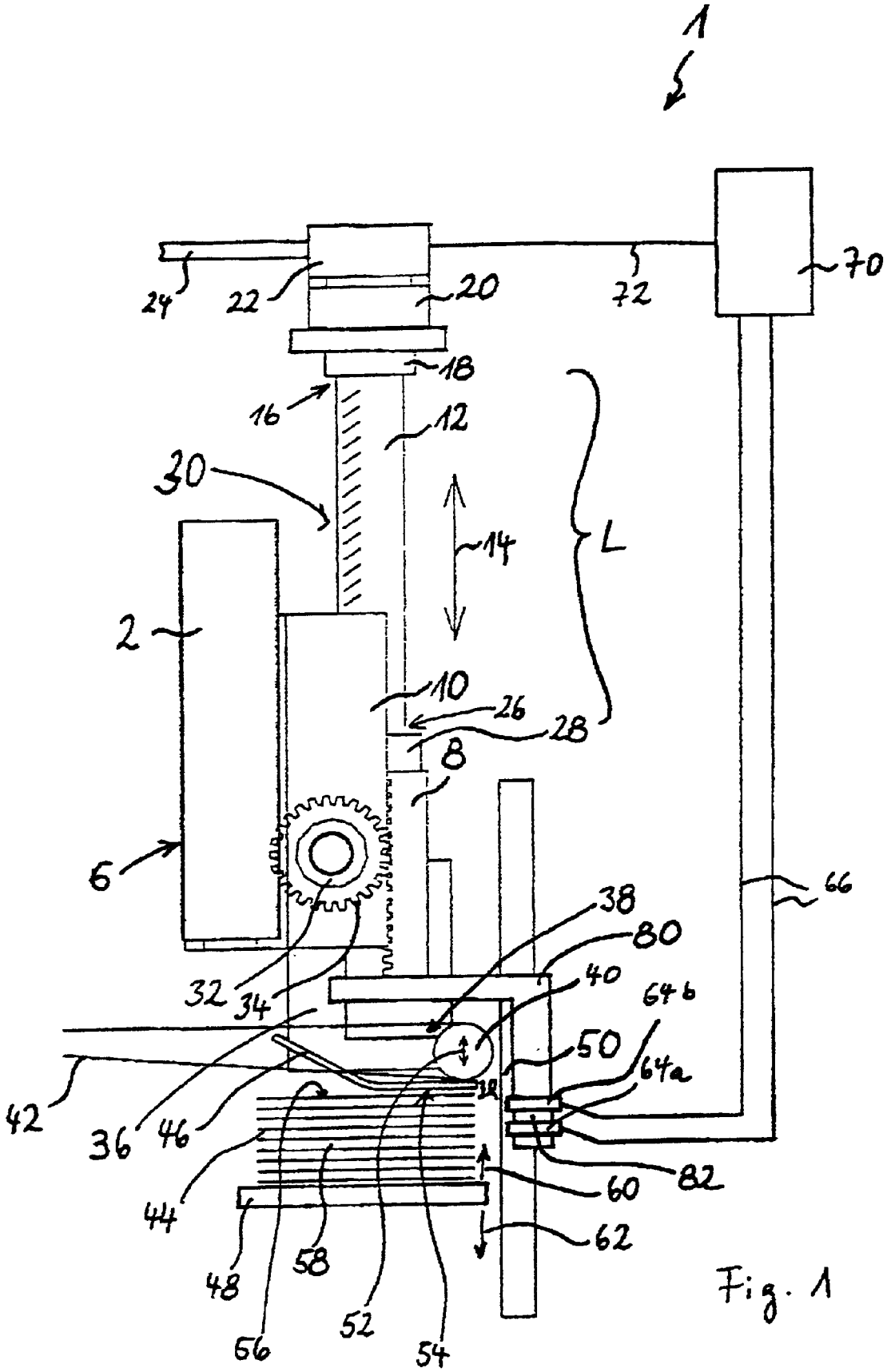
FIG. 1 is a side elevational view of an apparatus which embodies one form of the present invention.
Figure 2:
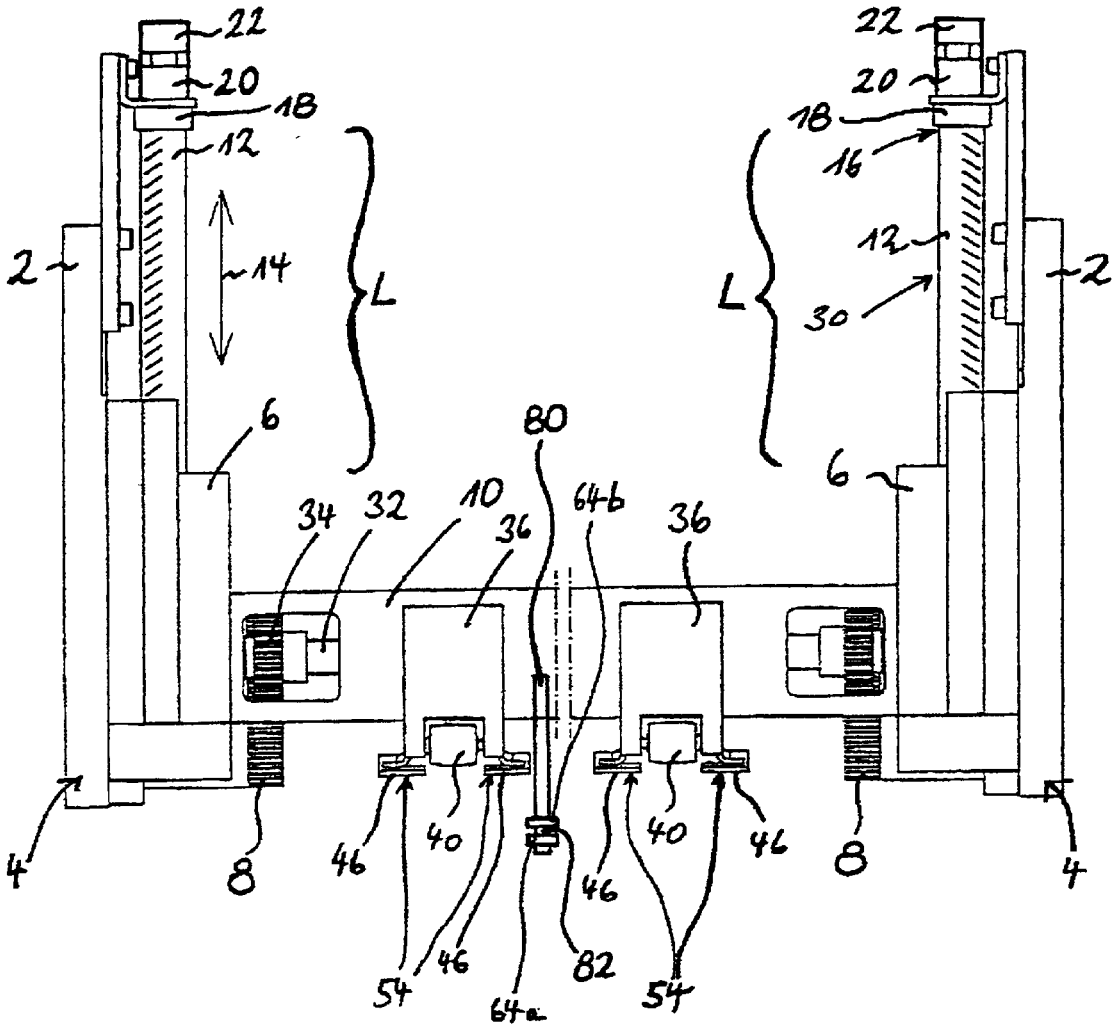
FIG. 2 is a smaller-scale fragmentary front elevational view of the apparatus, with the stack gathering devices and certain other parts omitted.

The apparatus 1 which is shown in FIGS. 1 and 2 comprises means for simultaneously converting two parallel streams or flows of successive (partially overlapping or non-overlapping) sheets 44 (e.g., paper sheets of identical size, composition and shape) into stacks or piles 58 of preferably accurately overlapping superimposed sheets (one such stack is shown in FIG. 1). This apparatus comprises a frame or housing 2 having spaced-apart upright sidewalls 4 (see FIG. 2). A somewhat similar housing is shown in commonly owned German patent application Serial No. 42 240 10.

The frame 2 further comprises upright supporting walls 6 each of which is borne by a different one of the two sidewalls 4. Each supporting wall 6 cooperates with a discrete partially confronting upright toothed rack 8 to constitute therewith a guide for a vertically movable horizontal support or platform 10. The latter is movable up and down (see the double-headed arrow 14) between the sidewalls 4 by a novel and improved moving or displacing unit including a pair of deformable (inflatable and deflatable) elastic upright hoses 12. The upper end portion 16 of each hose 12 is provided with a suitable connector 18 which is sealingly connected to a discrete valve 20, preferably an electrically operated (such as electromagnetic) valve. When the valves are opened, they can admit a compressed fluid (such as air or another gaseous fluid) from discrete sources 22 into the respective hoses 12. The sources 22 can receive fluid from a common main source (not shown) or from discrete main sources by way of a fluid-supplying conduit 24 or from two discrete conduits 24.

The lower end portions 26 of the two hoses 12 are sealingly secured to the adjacent portions of the platform 10 by suitable connectors 28. When the valves 20 are at least partially open to the respective sources 22 and to the respective hoses 12, the major (median) portions 30 of the two hoses bulge outwardly not unlike a pair of muscles and cause the platform 10 to rise, together with certain component parts of the apparatus 1 which will be fully described hereinafter and include means for supplying sheets 44 to the respective ones of two stacking stations. Portions of each of these stations are shown in FIG. 2 and one such station is shown in its entirety in FIG. 1. Thus, admission of compressed fluid into the hoses 12 through the respective valves results in a reduction of the lengths L of these two hoses and entails a lifting of the platform 10. If the valves 20 are adjusted to permit escape of compressed air from the deformed hoses 12, the lengths L of such hoses increase (i.e., the diameters of the two hoses are again uniform from end to end or the hoses are less deformed) and the platform 10 is caused to move downwardly toward the lower end position shown in each of FIGS. 1 and 2.

The platform 10 carries a rotary horizontal shaft 32 which mounts two spur gears 34 or other suitable gears mating with the respective upright toothed racks 8 and cooperating with such racks to ensure that the orientation (inclination) of the platform remains unchanged irrespective of whether the platform is caused to move up or down, i.e., irrespective of whether or not the median or major portions 30 are caused to expand radially outwardly or contract radially inwardly.

The lower parts of the end portions of the platform 10 carry L-shaped supporting brackets 36 having end portions 38 which mount pulleys or rollers 40 for endless flexible elements 42 (such as belts or bands and hereinafter referred to as belts) one of which is shown in FIG. 1 and which form part of means for advancing successive sheets 44 of the respective streams of sheets to the corresponding stacking stations, i.e., toward the respective stack gathering and supporting devices 48 (such as platforms, plates or pallets and hereinafter called pallets). When properly positioned at the respective stacking stations, the pallets 48 are located at levels below the discharge ends of the elongated paths defined at least in part by the belts 42, i.e., below the pulleys 40 of the sheet advancing means further including the belts 42 and the means for driving the belts in such a way that their sheet-advancing stretches or reaches advance in a direction to the right, as viewed in FIG. 1. The belts 42 preferably further serve as a means for guiding the sheets 44 of the corresponding streams along their respective paths toward the corresponding stacking stations.

The brackets 36 further carry sheet deflectors 46 which serve to direct successive sheets 44 of the respective streams of sheets 44 from the sheet-contacting surfaces of the respective belts 42 toward the corresponding pallets 48, i.e., toward the upper sides of empty pallets or toward the upper sides of uppermost sheets already stacked on the pallets. An upright wall or stop 50 (shown only in FIG. 1) is provided in front of the two stacking stations to arrest successive oncoming sheets 44 in predetermined positions before such sheets begin to descend toward the upper sides of the respective pallets 48 or toward the upper sides of sheets already resting on the respective pallets. Additional details of the exact manner of and of means for directing successive sheets 44 from the respective belts 42 toward and into the corresponding stacking stations will be readily understood upon perusal of the disclosures in commonly owned German patent application Serial No. 199 28 367 A1 and the aforementioned U.S. Pat. No. 5,397,120 to Schulz et al.

The hoses 12 of the means for moving the platform 10 in directions indicated by the double-headed arrow 14 are or can be of the character known as Fluidmuscle MAS-20-N-340-AA-MCHK-187610 and distributed by the German Firm Festo. The pulleys 40 share the movements of the platform 10 in the directions indicated by the double-headed arrows 14 (see the double-headed arrow 52 in FIG. 1). The same applies for the belts 42 and the deflectors 46, i.e., these parts also share all movements of the platform.

The distance or spacing 1 between the undersides 54 of each pair of deflectors 46 and the upper side 56 of the topmost sheet 44 of the stack 58 on the pallet 48 between such pair of deflectors is maintained at least substantially constant by causing appropriate displacements of the deflectors upwardly (arrow 60 in FIG. 1); such displacements are shared by the foremost portion of the respective belt 42, i.e., by that portion which is trained over the pulley 40 adjacent the stop 50.

In order to ensure that the distance 1 remains at least substantially constant not only during accumulation of a stack 58 on the respective pallet 48 but also during other stages of operation of the improved apparatus 1, such as during removal of a pallet 48 with a fully grown stack 58 thereon and/or during insertion of an empty pallet or reintroduction of an emptied pallet, the improved apparatus 1 comprises certain additional components including pairs of sensors or detectors 64*a*, 64*b* which monitor the width (height) of the clearance 1 and transmit appropriate signals to a control circuit or unit 70 (e.g., a computer) by way of conductor means 66. The detectors 64*a*, 64*b* can constitute commercially available photoelectronic light sensors which monitor the adjacent spaces for the presence or absence of sheets 44 therein. These detectors are mounted on a holder or bracket 80 in the form of an inverted L-shaped arm carried by one of the respective holding brackets 36, i.e., the detectors are held in fixed positions relative to the respective deflectors 46.

The undersides 54 of the pairs of deflectors 46 associated with each of the two stacking stations are located at a fixed distance from a plane or level 82 which is disposed midway between the upper and lower detectors 64*b*, 64*a*. Such fixed distance is related to the selected width of the clearance 1.

The signals which the detectors or sensors 64*a*, 64*b* transmit to the respective inputs of the control circuit or unit 70 by way of the corresponding conductors 66 enable the control unit to calculate the actual width of the clearance and to transmit appropriate signals to the valves 20 (via conductor means 72) when the actual width of such clearance deviates from the preselected (desired or optimum) width 1 to one of a preselected range of extents.

The operation of the improved stream converting or sheet stacking apparatus 1 is as follows:

If a freshly loaded pallet 48 is to be replaced with an empty pallet, the upper side of the freshly gathered stack 58 is or can be located at (i.e., it can descend in the direction of arrow 62 to) a level such that the actual clearance exceeds the desired (preselected) clearance between the undersides 54 of the pairs of cooperating deflectors 46 and the upper side 56 of the stack 58 on the freshly loaded pallet. If the actual clearance corresponds to the desired clearance 1, the upper side 56 of the stack 58 is located in the plane 82, i.e., midway between the detectors 64*a* and 64*b*. Thus, at such time only the lower detector 64*a* is exposed to light which is reflected by the adjacent side of the stack 58 on the pallet 48, i.e., such reflected light cannot influence the detector 64*b* which is mounted at a level above the detector 64*a*.

If the pallet 48 continues to descend in the direction of arrow 62, the upper side 56 of the (fully grown) stack 58 descends to a level below the range of the lower detector 64*a*. The signal from the detector 64*a* to the control unit 70 is processed by the latter together with the signal from the detector 64*b* in the following manner: The signal processing arrangement of the control unit 70 reaches the conclusion that the actual distance 1 is excessive, i.e., that it exceeds the preselected distance. Therefore, the control unit 70 transmits to the valves 20 signals (via conductor means 72) to permit escape of compressed fluid from the hoses 12 with the result that the hoses 12 are lengthened so that the platform 10 is lowered and moves the deflectors 46, the detectors 64*a*, 64*b* and the belts 42 (with the corresponding pulleys 40) in the direction indicated by the arrow 62. Such lowering is terminated when the plane of the point 82 between the detectors 64*a* and 64*b* again coincides with the plane of the upper side 56 of the stack 58 on the pallet 48. The valves 20 are automatically closed when the signals from the detectors 64*a*, 64*b* to the control unit 70 again indicate that the actual (monitored) distance between the upper side 56 of the stack 58 and the undersides 54 of the deflectors 46 is reduced to the preselected distance 1.

If the actual distance between the undersides 54 of the deflectors 46 and the upper side 56 of the stack 58 on the pallet 48 is less than the preselected distance 1, each of the detectors 64*a*, 64*b* is exposed to light which is reflected by the adjacent (front) side of the stack 58. Such situation is illustrated in FIG. 1. The conductors 66 transmit corresponding signals to the control unit 70 which interprets these signals in a manner such that the actual (monitored) distance is less than the preselected distance. The conductors 72 then transmit signals which cause the valves 20 to connect the hoses 12 with the respective sources 22 of compressed fluid. This causes a lifting of the platform 10 (i.e., the effective lengths of the hoses 12 are reduced) together with the deflectors 46 (see the arrow 60) until the actual distance between the upper side 56 of the stack 58 on the pallet 48 and the undersides 54 of the deflectors 46 again matches the preselected distance 1. Such situation is established when the upper side 56 of the stack 58 is again located in the plane of the point 82 between the detectors 64*a*, 64*b*, i.e., when the front side of the stack 58 can reflect or direct light against the lower detector 64*a* but not against the upper detector 64*b*.

As already mentioned hereinbefore, the detectors 64*a*, 64*b* can constitute commercially available photo-diodes or any other suitable light-sensitive sensor means. The signals (via conductor means 66) from the detectors 64*a*, 64*b* to the control unit 70 are indicative of the intensity or intensities of radiation impinging upon that side of the detector 64*a* or upon those sides of the detectors 64*a*, 64*b* which confronts or confront the adjacent side(s) of the detector(s).

The lifting and lowering devices including the hoses 12 and valves 20 constitute but one form of means for moving the sensors 64*a*, 64*b*, the platform 10, the belts 42 and the deflectors 46 in directions indicated by the double-headed arrow 14. For example, such devices can be replaced with one or more feed screws driven by reversible electric motor means or by other suitable prime mover means and receiving appropriate signals from the control unit 70 or from another suitable control unit which can evaluate and process signals furnished by the detectors 64*a*, 64*b* or the like.

The method and the apparatus of this invention invariably ensure that, even when the sheets 44 are supplied to each of the stacking stations (i.e., to the pallet or pallets 48) at a very high frequency, the leaders or front portions of successive sheets 44 do not undergo any or any appreciable deformation. Such leaders are particularly likely to undergo deformation or excessive deformation during conversion of sheets 44 in the streams of sheets into sheets in the stacks 58 of sheets on the corresponding pallets 48. Such advantages of the novel method and apparatus are attributable to preferably continuous monitoring (at 64*a*, 64*b*) of the actual distance between the underside 54 and the upper side 56 and to its comparison with the selected optimum distance 1 between the sides 54, 56. This ensures that the pallets 48 accumulate stacks 58 of properly oriented (such as accurately overlapping) sheets 44, even under the most adverse circumstances, and applies particularly for the leading ends or leaders of the sheets 44, i.e., for those marginal portions which come nearest to the stop 50. Such prerequisites should be met particularly if the sheets 44 are relatively large and/or if they consist of a thin material, such as readily deformable metallic or plastic foils. The adherence to a preselected distance 1 (or the absence of a pronounced departure from such preselected distance) ensures that the stacks 58 consist of accurately aligned (overlapping) sheets, even if the sheets are prone to deformation, i.e., even if the sheets cannot be readily handled with the same degree of facility as relatively small and/or relatively stiff sheets of paper or the like.

The advantages of the improved method and apparatus are even more readily apparent during certain specific stages of processing of sheets 44 on their way toward and onto the respective pallet(s) 48. For example, a replacement of a freshly loaded pallet 48 with an unoccupied (e.g., freshly emptied) pallet can be carried out in a manner which is much simpler and less time-consuming than the manner of carrying out such operation in a conventional apparatus. This is accomplished in a surprisingly simple and efficient manner by ensuring that the preselected distance 1 is matched by the actual (monitored) distance even when a freshly loaded pallet at a stacking station is to be or is being replaced with an empty pallet. Thus, all that is necessary is to cause the deflectors 46 and the belt or belts 42 to follow the short-lasting downward movement of the loaded pallet (arrow 62). The same applies for that stage of operation of the improved apparatus 1 which follows the replacement of a freshly loaded pallet 48 with an empty pallet; this involves an upward movement (arrow 60) of the empty pallet until its upper side rises to the level 82, i.e., the belt or belts 42 and the deflectors 46 then rise with the platform 10 to thus ensure that the distance between the topmost sheet 44 of the growing stack 58 on the newly introduced pallet matches or at least very closely approximates the preselected distance 1. Thus, the dimensions of the space which is available for the transfer of successive sheets 44 from their predetermined path toward the stop 50 remain unchanged (i.e., they are not unduly reduced or unduly increased) with attendant advantages regarding the accuracy and predictability of each stacking operation.

The numerous presently known important advantages of the improved method of stacking sheets of paper or the like can be summarized as follows: The method is less dependent upon the quality and/or upon the size and/or upon the composition of the sheets than heretofore known methods; it renders it possible to avoid deformation of and/or other damage to the sheets, especially to the leaders of the sheets, even if the sheets are stacked at a high or very high rate of speed or frequency; it renders it possible to establish an optional relationship between the positions of the already stacked sheets and those of the oncoming sheets at the station or stations where one or more streams of successive partially overlapping or non-overlapping sheets are being converted into stacks of overlapping sheets; it renders it possible to accurately monitor the positions of the already stacked or about to be stacked sheets relative to each other; it renders it possible to stack relatively large and/or readily flexible and similarly deformable sheets with the same or practically identical degree of accuracy and reproducibility as relatively small and/or relatively stiff sheets of paper, metallic or plastic foil and the like; and it renders it possible to simplify and to accelerate the removal of finished (fully grown) stacks from the stacking station(s).

The following are but a few presently known novel features and advantages of the improved apparatus: The apparatus embodies novel and improved means for moving the partially or fully grown stacks of overlapping sheets of paper or the like and the sheet supplying means relative to each other; it comprises novel and improved means for maintaining the growing stack(s) and the sheet supplying means in optimum positions relative to each other; it embodies novel and improved means for advancing and/or otherwise manipulating (such as guiding) the sheets on their way to the stacking station(s); it embodies novel and improved means for monitoring the positions of stacked sheets and/or still advancing sheets relative to each other; and it can handle one or more streams of sheets with the same degree of facility and accuracy.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art of converting streams of successive sheets into stacks of overlapping sheets and, therefore, such adaptations should and are intended to be comprehended within the meaning and range of equivalence of the appended claims.

What is claimed is:

1. A method of converting at least one stream of successive sheets into at least one series of stacks of sheets at a stacking station, comprising the steps of:

advancing successive sheets of the at least one stream to the stacking station along a predetermined path having a discharge end directly over the stacking station;

accumulating the sheets at the stacking station into a growing stack having uppermost sheets constituted by successive sheets of the at least one stream, the uppermost sheets being spaced apart from the discharge end of the predetermined path;

changing the level of the discharge end of the predetermined path when necessary to ensure that the distance between the discharge end and successive uppermost sheets of the growing stack remains at least substantially constant;

monitoring the distance between the discharge end of the predetermined path and successive uppermost sheets of the growing stack at the stacking station; and comparing the monitored distance with a predetermined distance, said level changing step including changing the level of the discharge end of the predetermined path when the monitored distance departs from the predetermined distance.

2. The method of claim 1, wherein said level changing step includes changing the level of the discharge end of the predetermined path when the monitored distance departs from the predetermined distance to a predetermined extent.

3. The method of claim 2, wherein said predetermined extent encompasses a predetermined range of tolerances.

4. A method of converting at least one stream of successive sheets into at least one series of stacks of sheets at a stacking station, comprising the steps of:

advancing successive sheets of the at least one stream to the stacking station along a predetermined path having a discharge end at the stacking station;

accumulating the sheets at the stacking station into a growing stack having uppermost sheets constituted by successive sheets of the at least one stream,the uppermost sheets being spaced apart from the discharge end of the predetermined path;

lowering the growing stack in the course of said accumulating step;

changing the level of the discharge end of the predetermined path when necessary to ensure that the distance between the discharge end and successive uppermost sheets of the growing stack remains at least substantially constant;

monitoring the distance between the discharge end of the predetermined path and successive uppermost sheets of the growing stack at the stacking station; and comparing the monitored distance with a predetermined distance, said level changing step including changing the level of the dishcarge end of the predetermined path when the monitored distance departs from the predetermined distance.

5. The method of claim 4, further comprising the step of removing the stack from the stacking station when the number of sheets in the stack rises to a predetermined number.

6. The method of claim 4, further comprising the step of removing the stack from the stacking station when the height of the stack reaches a predetermined value.

7. The method of claim 1, wherein said accumulating step includes depositing successive sheets of the at least one stream upon a removable first support at the stacking station, and further comprising the steps of:

removing the first support from the stacking station when the number of sheets in the fully grown stack on the first support reaches a preselected number;

replacing the removed first support with an empty second support; and raising the second support at the stacking station toward the discharge end of the predetermining path.

8. A method of converting at least one stream of successive sheets into at least one series of stacks of sheets at a stacking station, comprising the steps of:

advancing successive sheets of the at least one stream to the stacking station along a predetermined path having a discharge end at the stacking station;

accumulating the sheets upon a first support at the stacking station into a growing stack having uppermost sheets constituted by successive sheets of the at least one stream, the uppermost sheets being spaced apart from the discharge end of the predetermined path;

changing the level of the discharge end of the predetermined path when necessary to ensure that the distance between the discharge end and successive uppermost sheets of the growing stack remains at least substantially constant;

monitoring the distance between the discharge end of the predetermined path and successive uppermost sheets of the growing stack at the stacking station; comparing the monitored distance with a predetermined distance, said level changing step including changing the level of the discharge end of the predetermined path when the monitored distance departs from the predetermined distance;

lowering the first support and the fully grown stack thereon prior to removing the stack; and lowering the discharge end of the predetermined path simultaneously with lowering of the first support and the fully grown stack on the first support.

9. Apparatus for converting at least one stream of successive sheets into at least one series of stacks of sheets at a stacking station, comprising:

means for advancing successive sheets of the at least one stream to the stacking station along a predetermined path, said advancing means having a discharge end directly over said station;

means for accumulating the sheets at said station into a growing stack having uppermost sheets constituted by successive sheets of the at least one stream the uppermost sheets being spaced apart from said discharge end; and means for changing the level of said discharge end when necessary to ensure that the distance between said discharge end and successive uppermost sheets of the growing stack remains at least substantially constant wherein said level changing means includes signal generating means for monitoring the distance between said discharge end and succesive uppermost sheets of the growing stack at said station, means for comparing the monitored distance with a predetermined distance, and means for moving said discharge end when the monitored distance departs from the predetermined distance.

10. The apparatus of claim 9, further comprising a removable support located at said stacking station and arranged to carry the sheets of the growing stack.

11. The apparatus of claim 9, wherein said advancing means comprises at least one endless flexible element arranged to advance and guide successive sheets of the at least one stream and having an end turn disposed at said discharge end and located at said distance from the uppermost sheets of the stack growing at said station.

12. The apparatus of claim 9, wherein said advancing means comprises at least one sheet deflector arranged to guide successive sheets of the at least one stream and having a sheet-contacting surface disposed at said discharge end and located at said distance from the uppermost sheets of the stack growing at said station.

13. Apparatus for converting at least one stream of successive sheets into at least one series of stacks of sheets at a stacking station, comprising:

means for advancing successive sheets of the at least one stream to the stacking station along a predetermined path, said advancing means having a discharge end above said station;

means for accumulating the sheets at said station into a growing stack having uppermost sheets constituted by successive sheets of the at least one stream, the uppermost sheets being spaced apart from said discharge end;

means for changing the level of said discharge end when necessary to ensure that the distance between said discharge end and successive uppermost sheets of the growing stack remains at least substantially constant; and a removable support located at said station and arranged to carry the sheets of the growing stack, and means for lowering said support with a growing stack thereon wherein said level changing means includes signal generating means for monitoring the distance between said discharge end and successive uppermost sheets of the growing stack at said station, means for comparing the monitored distance with a predetermined distance, and means for moving said discharge end when the monitored distance departs from the predetermined distance.

14. The apparatus of claim 9, wherein said level changing means includes at least one fluid-operated motor.

15. Apparatus for converting at least one stream of successive sheets into at least one series of stacks of sheets at a stacking station, comprising:

means for advancing successive sheets of the at least one stream to the stacking station along a predetermined path, said advancing means having a discharge end above said station;

means for accumulating the sheets at said station into a growing stack having uppermost sheets constituted by successive sheets of the at least one stream, the uppermost sheets being spaced apart from said discharge end; and means for changing the level of said discharge end when necessary to ensure that the distance between said discharge end and successive uppermost sheets of the growing stack remains at least substantially constant, wherein said level changing means includes at least one fluid-operated motor, and said motor includes at least one radially expansible and contractible hose.

16. The apparatus of claim 15, wherein said moving means is arranged to change the level of said discharge end when the extent of departure of said monitored distance from said predetermined distance is within a predetermined range.

17. The apparatus of claim 15, further comprising means for maintaining said monitoring means and said discharge end in fixed positions relative to each other.

18. The apparatus of claim 15, wherein said discharge end and said monitoring means are spaced apart from each other by a distance at least approximating said predetermined distance.

19. The apparatus of claim 15, wherein said moving means includes means for moving said discharge end in synchronism with said monitoring means.

20. The apparatus of claim 15, further comprising insertable and removable devices for supporting growing stacks at said stacking station, said level changing means being operative to change the level of said discharge end during accumulation of sheets on a device occupying said station, during insertion of a device into said station, as well as during removal of a stack-carrying device from said station.

21. The apparatus of claim 20, wherein said devices include pallets.

* * * * *